US007380574B2

(12) United States Patent
Wiedel

(10) Patent No.: US 7,380,574 B2
(45) Date of Patent: Jun. 3, 2008

(54) WIRE STRAPPER FOR WASTE MATERIAL BALER

(75) Inventor: John Wiedel, Chicago, IL (US)

(73) Assignee: Accent Packaging, Inc., Spring, TX (US)

( * ) Notice: Subject to any disclaimer, the term of this patent is extended or adjusted under 35 U.S.C. 154(b) by 0 days.

(21) Appl. No.: 11/675,900

(22) Filed: Feb. 16, 2007

(65) Prior Publication Data

US 2007/0137724 A1 Jun. 21, 2007

Related U.S. Application Data

(62) Division of application No. 10/709,110, filed on Apr. 14, 2004.

(51) Int. Cl.
*B21F 15/00* (2006.01)

(52) U.S. Cl. ..... 140/101

(58) Field of Classification Search ..... 140/93.6, 140/101, 105, 111, 115, 118, 149; 100/26, 100/31

See application file for complete search history.

(56) References Cited

U.S. PATENT DOCUMENTS 2,963,958 A * 12/1960 Nelson et al. ..... 100/11
3,037,535 A * 6/1962 Linehan et al. ..... 140/115
3,251,296 A * 5/1966 Smith ..... 100/26
3,295,436 A * 1/1967 Brouse et al. ..... 100/31
4,577,554 A * 3/1986 Brouse ..... 100/26
5,433,255 A * 7/1995 Wiedel ..... 140/115

OTHER PUBLICATIONS

Office Action dated Jul. 17, 2007 from U.S. Appl. No. 11/675,891, filed Feb. 16, 2007.

* cited by examiner

*Primary Examiner*—Ed Tolan
(74) *Attorney, Agent, or Firm*—Hovey Williams LLP

(57) ABSTRACT

A wire strapping or tying device (46) is provided having a rotatable pinion-type knotter assembly (56) for twist-knotting of a pair of adjacent wire sections (50*a*, 50*b*), together with a shiftable knotter cover (266) movable between a home position for maintaining the sections (50*a*, 50*b*) within the assembly (56) and a remote knotter access position allowing ready access to the knotter assembly (56). The cover (266) is supported by arms (268, 270) which are pivotal about an axis spaced from and generally parallel with the cover (266). The cover (266) may be manually shifted to the remote knotter access position through an arc of at least 45°. Also, the knotter assembly (56) includes a primary body (128) supporting a rotatable, slotted knotter pinion (178). The body (128) is pivotally secured to frame plates (68, 70), allowing the body (128) to be pivoted to a convenient position for servicing of pinion (178). Preferably, a mechanical operator assembly (198) is employed to sequentially operate all of the device components in a precise, timed sequence. A single drive assembly (196) preferably in the form of a piston and cylinder assembly (200) is used to actuate the assembly (198).

25 Claims, 17 Drawing Sheets

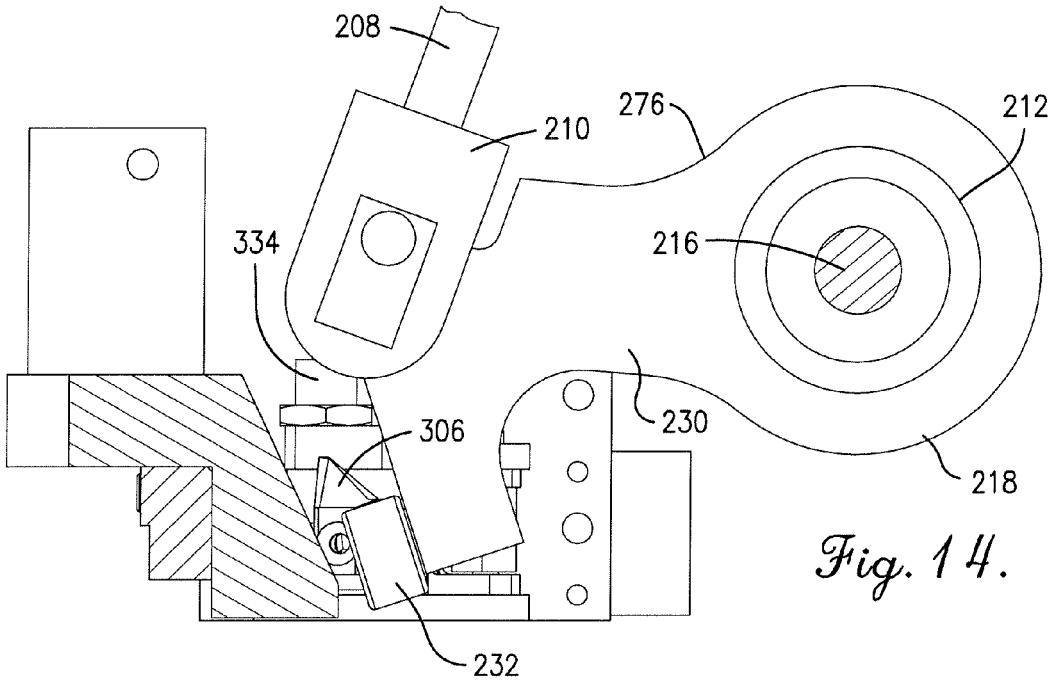
Fig. 14.
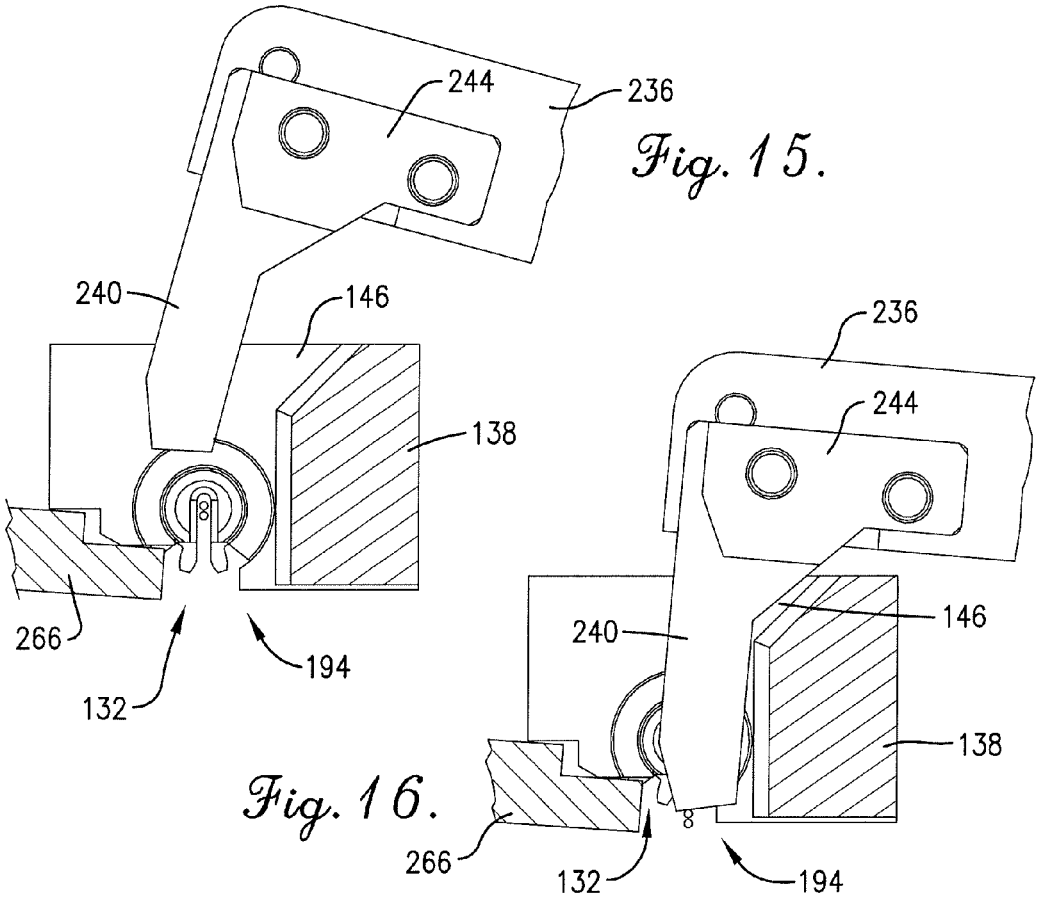
Fig. 15.
Fig. 16.

WIRE STRAPPER FOR WASTE MATERIAL BALER

RELATED APPLICATION

This is a divisional of application Ser. No. 10/709,110 filed Apr. 14, 2004, which is hereby incorporated by reference herein.

BACKGROUND OF THE INVENTION

1. Field of the Invention

The present invention is broadly concerned with wire strapping apparatus of the type used to apply knotted and tensioned wire ties to preformed bales such as compressed refuse bales. More particularly, the invention is concerned with such apparatus having features permitting quick and easy access to critical wire knotting components, so that the user may readily clear, repair and/or replace such components as necessary.

2. Description of the Prior Art

Various wire tying and strapping machines have been proposed in the past for applying knotted and tensioned wire ties to bales, packages or other articles. One class of these prior machines makes us of a continuous, two-piece wire track with an associated strapping device. In such units, a package or bale to be tied is positioned within the confines of the wire track, and a continuous strand of wire is advanced completely around the track and overlapped with itself. The wire is then tensioned and the overlapped sections are knotted together by twisting. This further tensions the wire to the point that the track sections are separated allowing the knotted and tensioned tie to snap into place about the bale or article. In some cases more complex devices are provided for ejecting the knotted wire from the track.

Commonly, a twister pinion is employed for twist-knotting of adjacent wire sections. Such a knotter pinion includes a slot to accommodate the wire sections and upon rotation of the pinion a defined number of turns or twists are created. In order to maintain the wires in the twister pinion and associated structure, a shiftable knotter cover located adjacent the twister pinion is used.

A significant problem with prior machines is the difficulty of readily clearing or servicing the twister pinion and related structure. Hence, in one prior machine design, it is necessary to physically detach the cover and disassemble the pinion apparatus for servicing purposes. In other instances, the cover is movable to only a very limited extent, making it very difficult to access the pinion.

Prior art patents relating to strapping devices include U.S. Pat. Nos. 4,777,554, 3,295,436, 2,922,359, and 4,817,519.

SUMMARY OF THE INVENTION

The present invention overcomes the problems outlined above and provides an improved knotting device of the type including a rotatable knotter operable to twist-knot a pair of adjacent wire sections and having a cover located proximal to the knotter for maintaining the wire sections within the knotter during knotter operations. In particular, the improved device has a mount for the knotter cover permitting the cover to be pivoted away from the knotter to a knotter access position remote from the home or wire-maintaining position and through an arc of at least about 45°, more preferably greater than about 60°, and most advantageously around 90°.

Preferably, the rotatable knotter is in the form of a slotted, rotatable pinion adapted to receive adjacent wire sections within the slot thereof, and the associated knotter cover is mounted on a leg pivotal about an access remote from the cover and generally parallel thereto. An over center spring is secured to the cover mount for biasing the cover to its home position, and also biasing the cover to its knotter access position when the cover is shifted away from the knotter.

In further preferred forms of the invention, the rotatable knotter is mounted to an elongated, axially pivotal support body. The body is mounted to a stationary frame member by way of a threaded couplers or any convenient means. Thus, when the cover is in its remote position, it is a simple matter to loosen the threaded couplers and rotate the support body to a position facilitating access to rotatable knotter.

In another aspect of the invention, a knotting device is provided having a knotting assembly comprising a gripper for selectively gripping one of two adjacent wire sections, a rotatable knotter operable to twist-knot the adjacent sections, a cutting element for cutting the other of the adjacent wire sections after twist-knotting of the sections, and a shiftable cover adjacent the knotter for obtaining the wire sections within the knotter during twist-knotting and thereafter movable to a wire-clearing position permitting passage of the twist-knotted wire sections from the knotter. In this case an operator assembly is provided for timed operation of the gripper, knotter, cutting element, and cover and a single drive assembly (e.g., a piston and cylinder assembly) is coupled with the operator assembly for effecting the timed operation.

Use of only a single drive assembly makes it possible to mechanically time the knotting device on a very precise basis. This in turn facilitates and speeds up the overall wire tying sequence. Preferably, the operator assembly includes a pivotal shaft carrying respective mechanical operator bodies for the gripper, knotter, cutting element and cover.

BRIEF DESCRIPTION OF THE DRAWINGS

FIG. 14 is a fragmentary vertical sectional view taken along line 14-14 of FIG. 6 and illustrating release of the gripping assembly by the action of the torque tube assembly;

FIG. 15 is a vertical sectional view taken along line 15-15 of FIG. 4 and showing the action of wire removal fingers prior to engagement of a knotted wire within the knotter pinion;

FIG. 16 is a view similar to that of FIG. 15 but showing the knotted wire fully removed from the knotting opinion;

DETAILED DESCRIPTION OF THE PREFERRED EMBODIMENT

Figure 1:
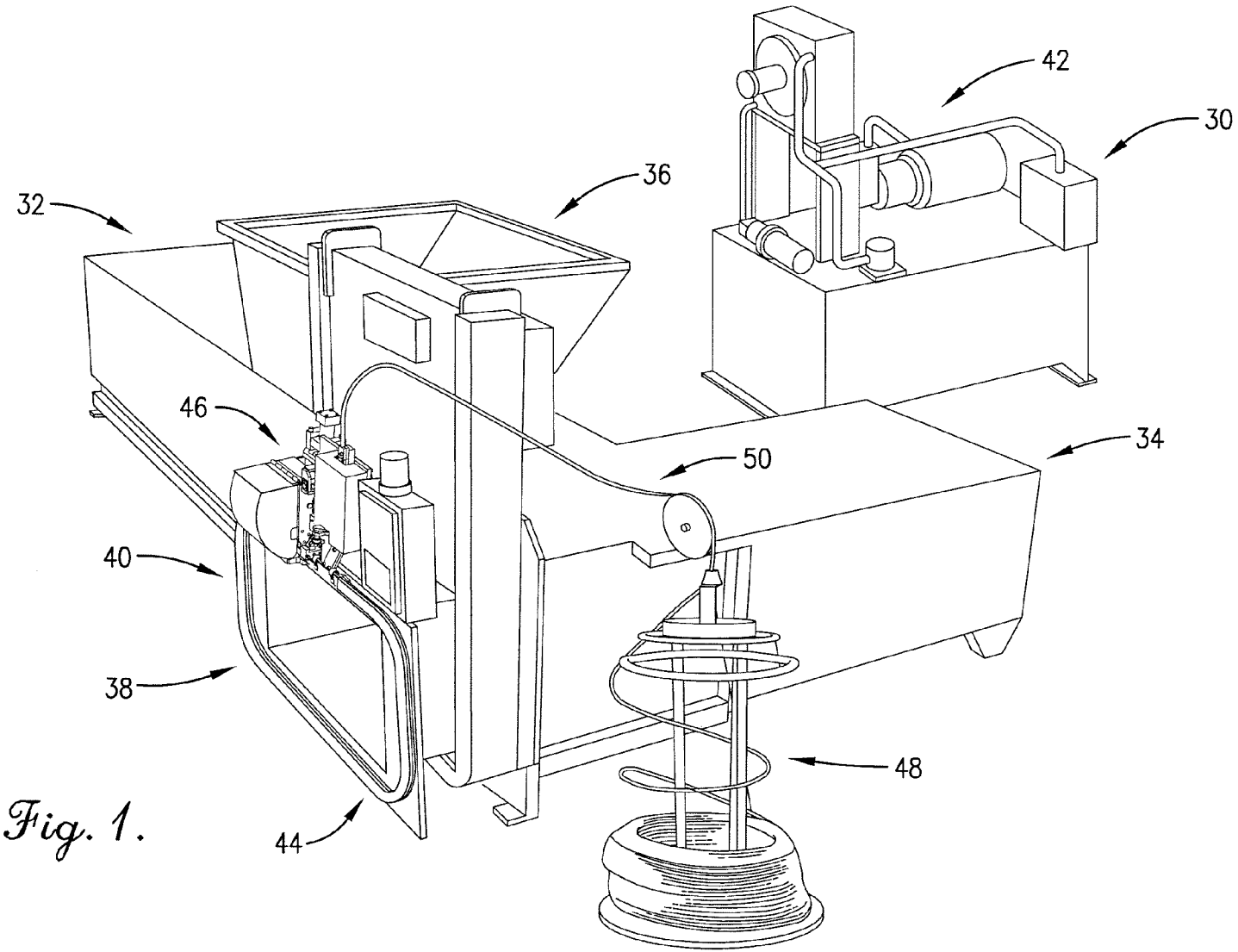
FIG. 1 is an isometric view of a dual-ram refuse baler equipped with the wire strapper of the present invention.

Turning now to the drawing, FIG. 1 illustrates a double ram refuse baler 30 designed to receive and compress refuse into large bales, and to eject such bales with one or more tensioned and knotted wires around the bale. Broadly, the baler 30 includes a compression ram chamber 32, an ejection ram chamber 34, an inlet hopper 36, a bale outlet 38, and a wire strapper 40 disposed about the outlet 38. The baler 30 is powered by means of a multiple stage hydraulic power unit 42. In operation, refuse is loaded into hopper 36 and is compressed using a ram (not shown) within chamber 32 to create an appropriately sized bale which is moved into the transverse chamber 34. Another ram (also not shown) within chamber 34 serves to eject the compressed bale through outlet opening 38. During the course of or after such ejection, the strapper 40 is operated to place one or more tensioned and knotted wire ties about the formed bale which can then be disposed of in conventional fashion. Balers of the type shown in FIG. 1 are available from a number of sources, such as Marathon Equipment Co.

Broadly speaking, the wire strapper 40 includes a spring-loaded, separable wire guide track 44 substantially circumscribing the opening 38, as well as a strapping device 46 located above the opening 38. A separate wire stand 48 is provided which has a supply of wire 50 which is fed to the inlet of device 46 during strapping operations.

The device 46 includes a number of assemblies operating in cooperation for effective bale tying. Again broadly speaking, the device 46 has (see FIGS. 2 and 3) a main frame assembly 51, pinch roll assembly 52, a wire entry assembly 54, a knotter assembly 56, a torque tube assembly 58, a hub gear and knotter cover assembly 60, a wire gripper assembly 62 and an exit assembly 64. As shown, opposed ends of the guide track 44 mate with the entry assembly 54 and exit assembly 64 respectively, so as to create a continuous wire path.

The frame assembly 51 is a rigid frame and has a bottom plate 66 and a pair of upstanding, apertured side plates 68, 70. It additionally has a laterally projecting plate 72 affixed to plate 70 and serving as a mount for pinch roll assembly 52. Finally, an upper cross-plate 74 is attached to and spans the side plates 68, 70 and is equipped with a large opening 76. A pair of upstanding bearing blocks 78, 80 are attached to the upper face of cross-plate 74 of opposite sides of opening 76.

Figure 2:
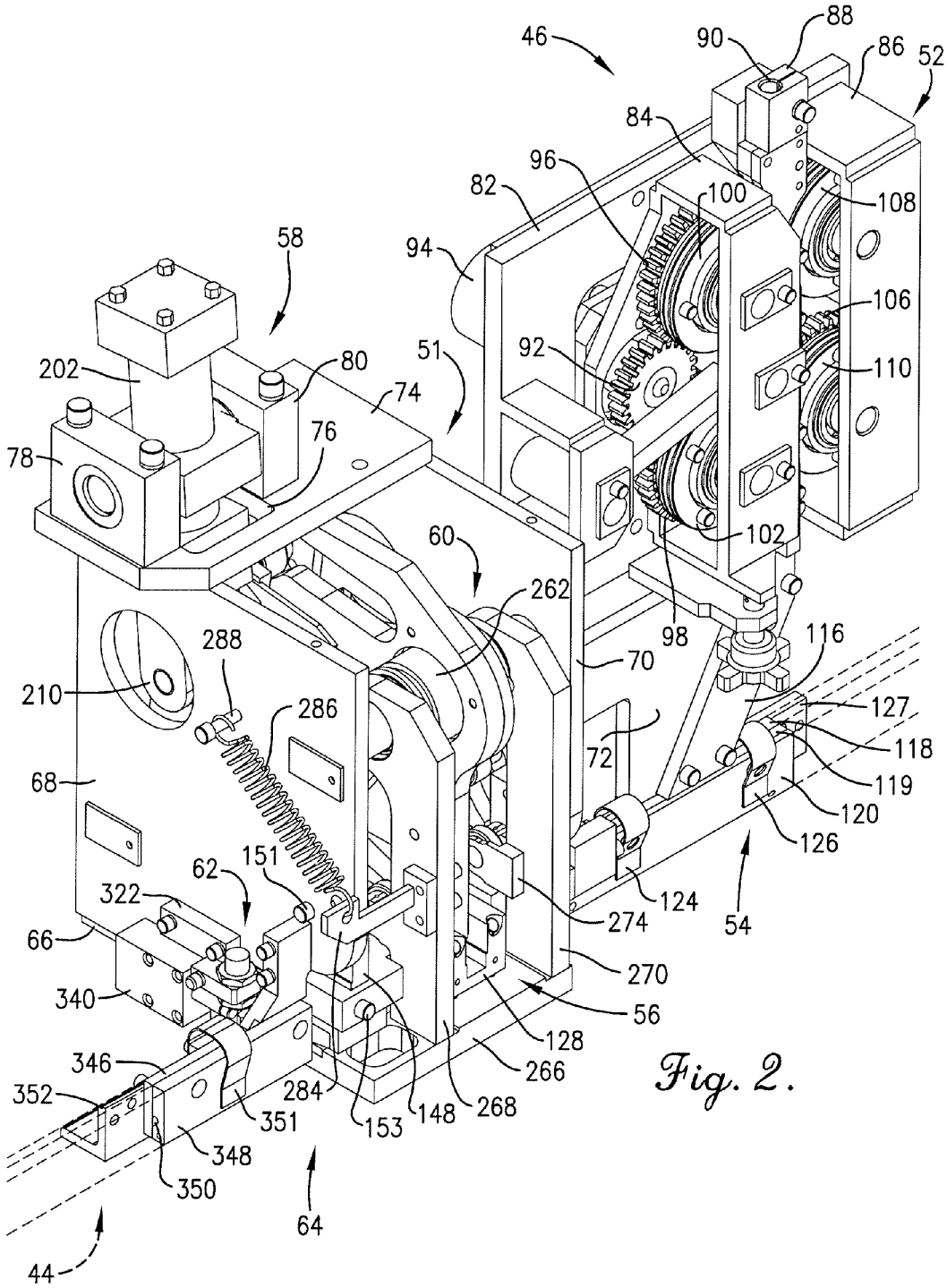
FIG. 2 is an isometric view of the strapping device forming a part of the overall wire strapper, depicting the device in the ready position thereof before initiation of a strapping operation.

The pinch roll assembly 52 includes a main, rearmost frame plate 82 supporting a pair of spaced apart subframes 84, 86 with a wire feeder 88 located between the subframes 84, 86 and having a wire entrance opening 90. As best seen in FIG. 2, a drive gear 92 is mounted on subframe 84 and is connected to a rearwardly extending drive motor 94. The gear 92 is in meshed, driving engagement with upper and lower gears 96, 98 housed within subframe 84; each of the gears 96, 98 carries a peripherally recessed wire gripper 100, 102. Mating gears 104, 106 are housed within subframe 86 and likewise carry peripherally recessed wire grippers 108, 110. A pair of upper and lower wire guides 112, 114 are also situated between the subframes 84, 86. The pinch roll assembly 52 is operable, as explained in more detail below, to draw the wire 50 from stand 48 downwardly through the pinch roll assembly into entry assembly 54 and the remainder of device 46. Thus, when drive gear 92 is rotated in a counterclockwise fashion as viewed in FIG. 2, gears 96, 98 and 104, 106 are rotated along with the associated grippers 100, 102 and 108, 110. This serves to pull the wire downwardly through the pinch roll assembly towards entry assembly 54. Likewise, rotation of the drive gear in a clockwise direction serves to retract the wire 50. It will be appreciated that the wire 50 travels through the feeder 88 and is cooperatively engaged by the grippers 100, 102 and 108, 110, being further guided by the guides 112, 114, for the purposes described.

Although the assembly 52 as described is preferred, it will be appreciated that a variety of other functional pinch roll assemblies could also be employed. See, e.g., U.S. Pat. No. 4,817,519.

Figure 3:
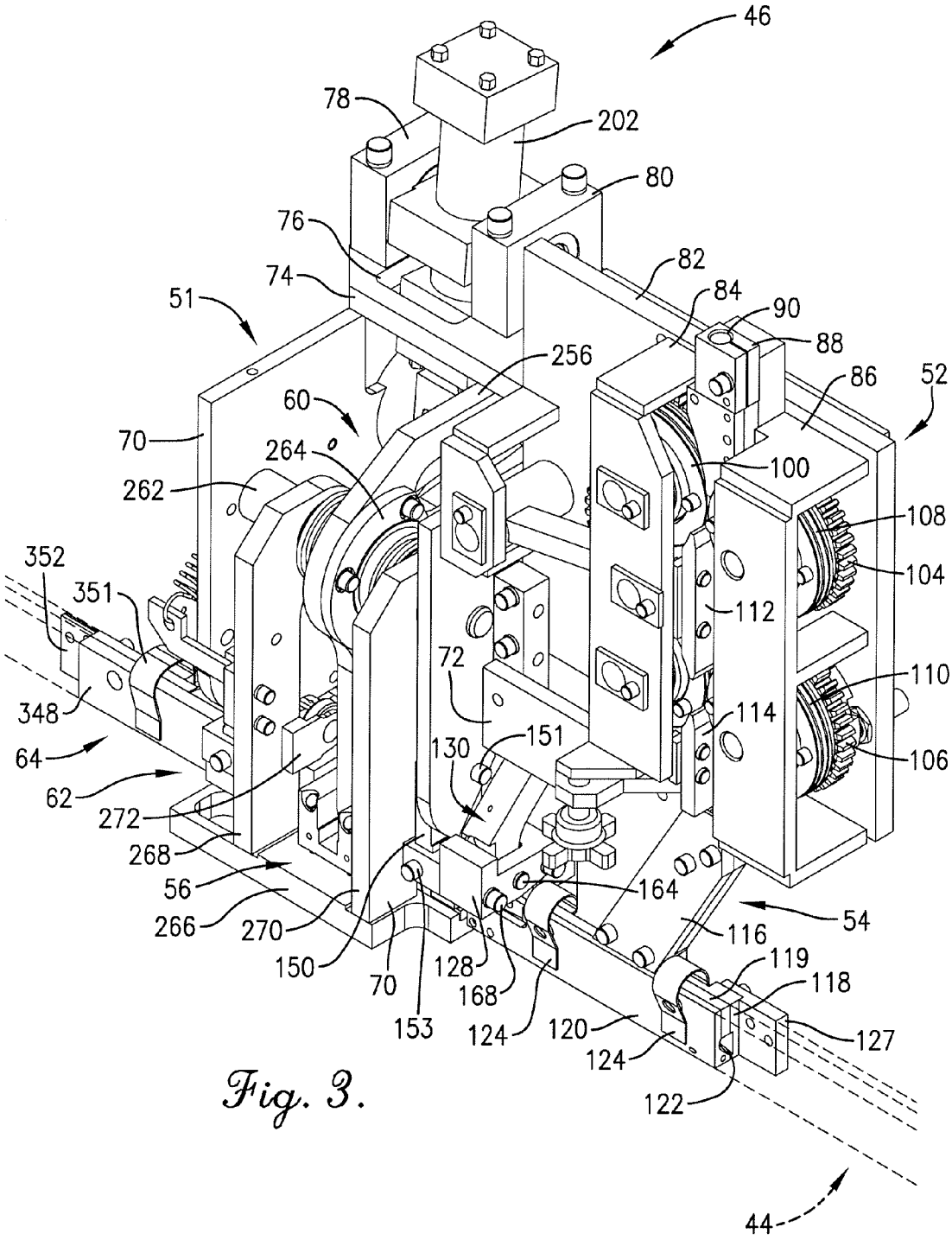
FIG. 3 is an isometric view similar to that of FIG. 2, but viewing the device from the opposite side illustrated in FIG. 2.
Figure 4:
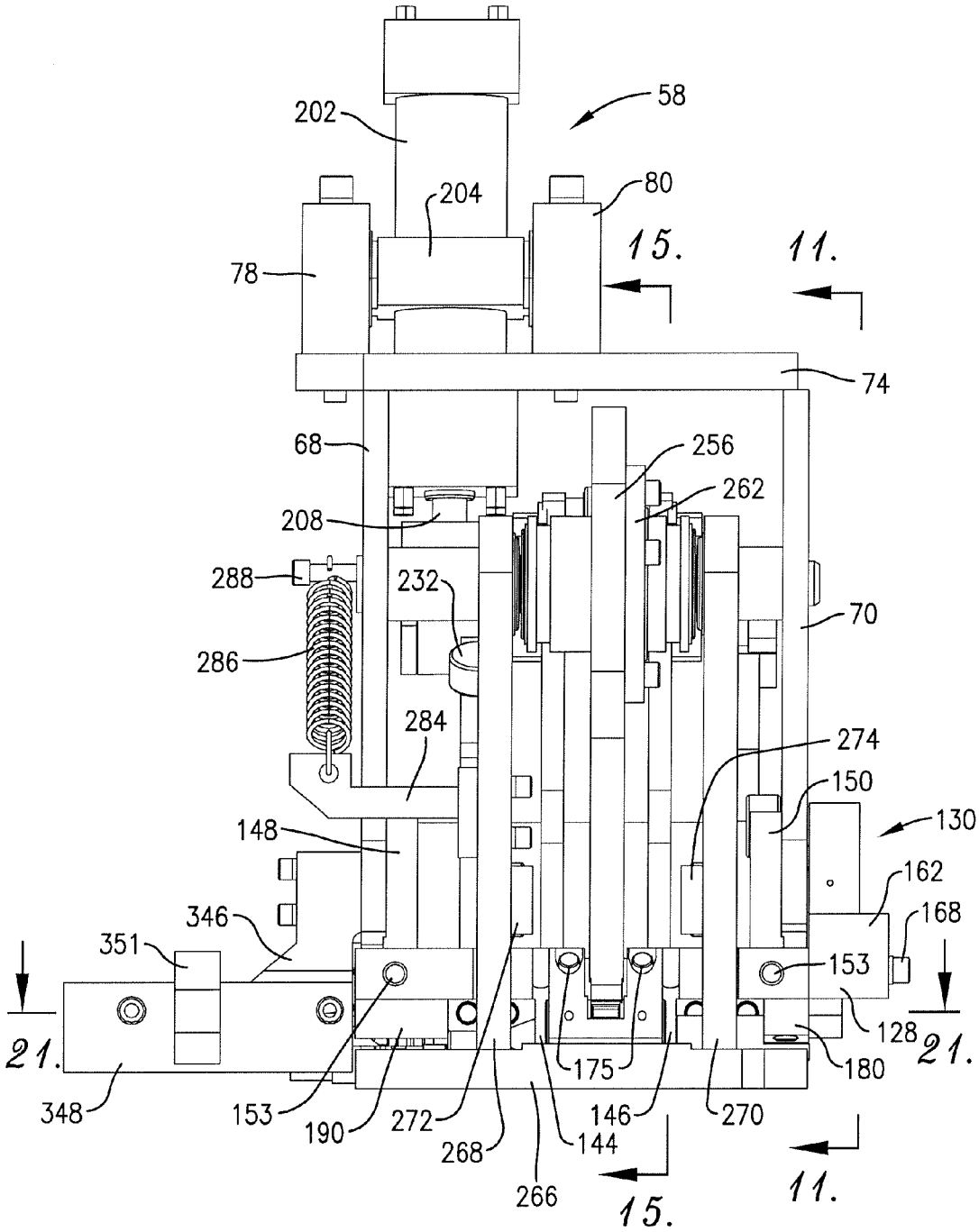
FIG. 4 is a front elevational view of portions of the strapping device, including the main frame assembly, knotter assembly, torque tube assembly, gear hub and knotter cover assembly, the gripper assembly and the exit assembly.

The entry assembly 54 includes an obliquely oriented plate 116 affixed to plate 72, as well as a pair of three laterally extending plates 118, 119, 120 which are supported by the plate 72. The plates 116, 72 cooperatively define a wire path leading from the wire outlet of pinch roll assembly 52 downwardly towards the plates 118-120. Plate 119 is configured to present an elongated wire path in alignment with the path defined by the plates 116, 72 thus forming a continuous wire path through assemblies 52, 54 and into the knotter assembly 56. As best seen in FIG. 3, a wire path 122 is defined between the plates 119 and 120, which communicates with the path defined by the guide track 44. The assembly 54 also includes a pair of spring clips 124, 126 serving to yieldably retain plate 120 adjacent plate 119. An L-shaped connector 127 serves to interconnect the assembly 54 with the adjacent end of continuous track 44.

The knotter assembly 56 includes (see FIG. 10) a primary block 128, cutter element 130 and knotter pinion assembly 132. The block 128 has a central section including a U-shaped segment 134 having a pair of upstanding wall sections 136, 138 with an opening 140 therebetween. The lower portion of segment 134 presents an arcuate surface 142. Elongated slots 144, 146 are provided on either side of the wall sections 136, 138. The ends of block 128 are equipped with upstanding apertured connector bodies 148, 150 which are designed for swingable attachment to the inboard faces of the frame walls 68, 70 via threaded connectors 151 (see FIGS. 2 and 3). The block 128 is normally retained in the operating position (shown in FIGS. 2 and 3) by removable threaded fasteners 153. However, the fasteners 153 can be removed so that the block 128 can be swung upwardly on connectors 151 to the maintenance position (shown in FIG. 8).

Figure 10:
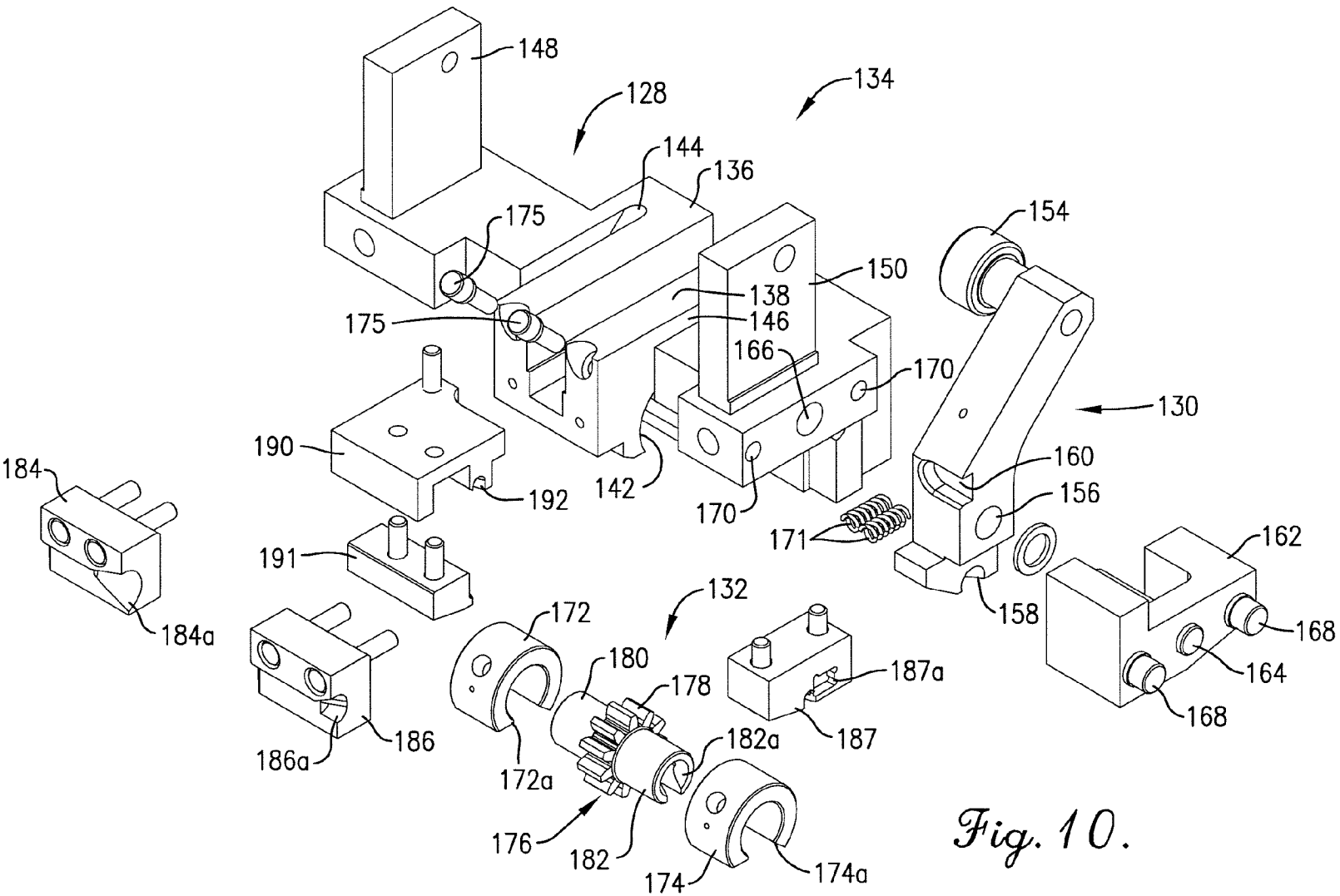
FIG. 10 is an exploded isometric view of the components of the knotter assembly.
Figure 13:
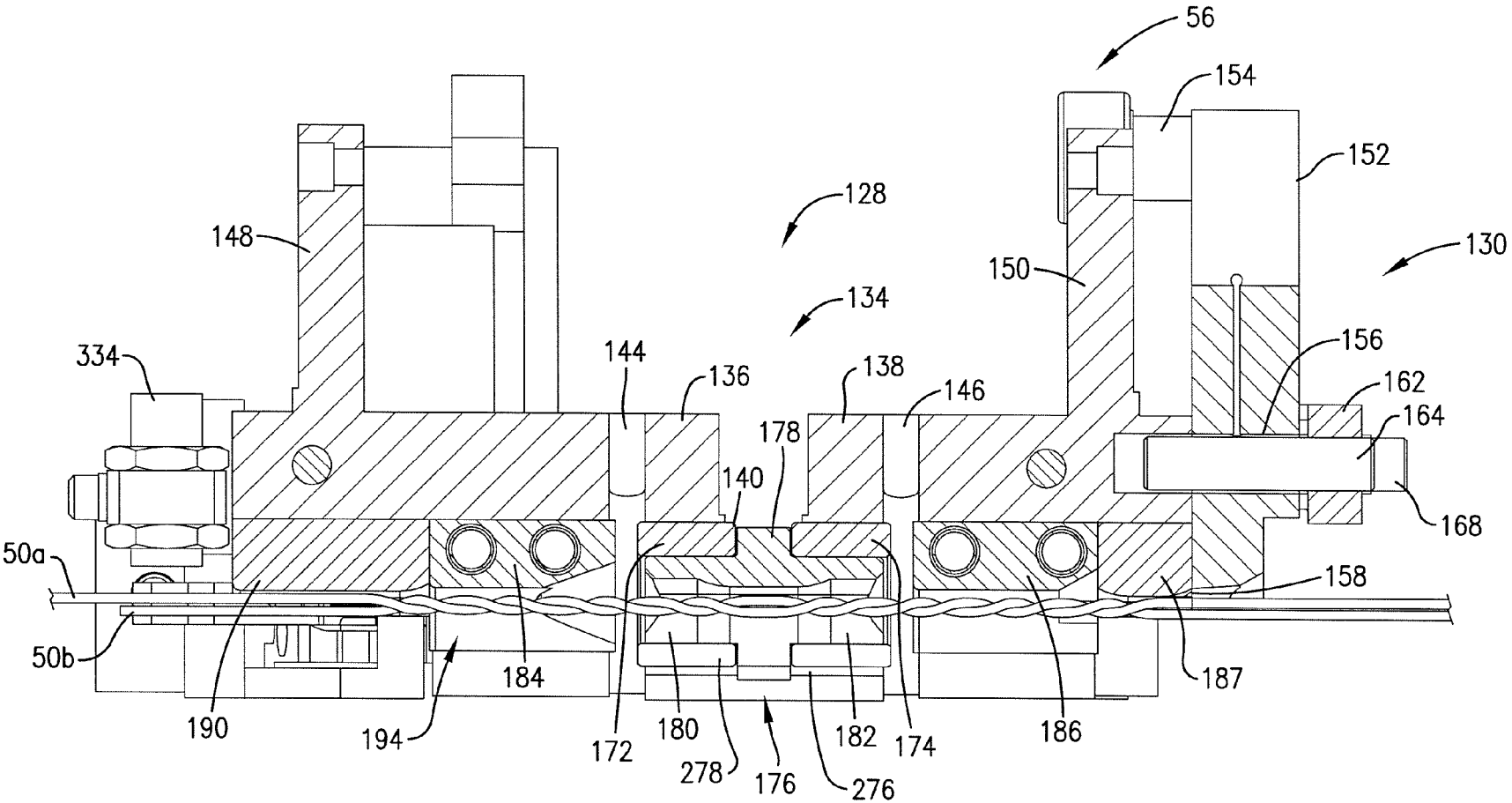
FIG. 13 is a vertical sectional view taken along line 13-13 of FIG. 11 and illustrating the knotted strapping wire prior to cutting thereof.

Knife element 130 is secured to the right-hand end of block 128 as viewed in FIGS. 10 and 13. The element 130 includes an obliquely and upwardly oriented section 152 having a laterally projecting follower 154 adjacent the upper end thereof. The lower end of the cutter includes a mounting bore 156, lowermost wire shearing surface 158 and spring-receiving recess 160. The element 130 is secured to block 128 by means of U-shaped end connector 162 which carries a pivot pin 164. Thus, the pin 164 extends through the bore 156 and seats within an aligned bore 166 provided in the butt end of body 128, allowing pivoting of the element 130. Coupler 168 extend through the ends of connector 162 and into corresponding tapped bores 170 in the block 128. A pair of bias springs 171 are seated within recess 160 with their opposite ends engaging the inner face of connector 162.

The knotter pinion assembly 132 includes a pair of arcuate bushings 172, 174 which are secured to the arcuate surface 142 of segment 134 via oblique couplers 175. The bushings 172, 174 support the opposed ends of pinion member 176 having a central pinion gear 178 and laterally extending support sections 180, 182 which are engaged by the corresponding bushings. It will be noted that the bushings, support sections and the pinion gear have mating, wire-receiving slots 172*a*, 174*a*, 178*a*, 180*a*, 182*a* which are important for purposes to be described.

A pair of wire guide blocks 184, 186 are affixed to block 128 on opposite sides of pinion assembly 132 and have an open lower end for passage of wire sections therethrough. As best seen in FIG. 10, the right-hand ends of the blocks have a tapered wire guiding surface 184*a*, 186*a*. A right-hand wire guide block 187 having a wire passageway 187*a* is secured to the underside of block 128 between block 186 and the lower extent of element 130. Also, a left-hand end wire guide block 190 carrying a secondary gripper block 191 and having a lower wire passageway 192 is affixed to the left-hand end of block 128 beneath connector body 148.

Referring to FIG. 13, it will be seen that the lower end of cutter element 130 adjacent shearing surface 158, wire passageway 187*a*, block 186, pinion assembly 132, block 184 and block 190 cooperatively define an elongated, open-bottom wire passageway generally referred to by the numeral 194 which extends throughout the entire length of the knotter assembly 56. This passageway 194 is sized so as to simultaneously accommodate separate, upper and lower segments of wire, namely a section of wire 50*a* extending entirely around the guide track 44 and along passageway 194 and a lower wire section 50*b* extending through passageway 194 (see FIG. 22*a*).

Figure 5:
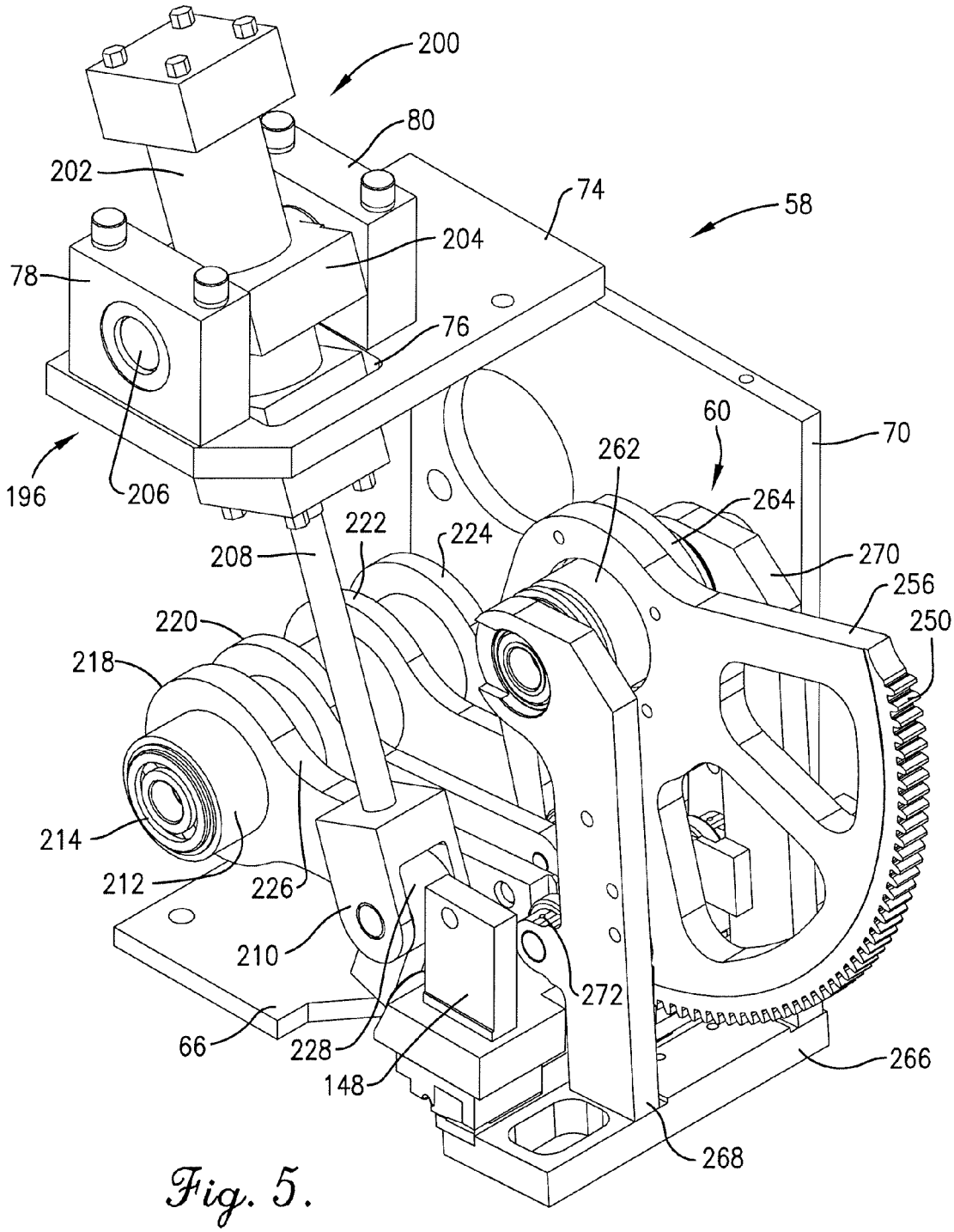
FIG. 5 is a fragmentary isometric view illustrating details of construction of portions of the main frame assembly, torque tube assembly and the gear hub and knotter cover assembly.
Figure 6:
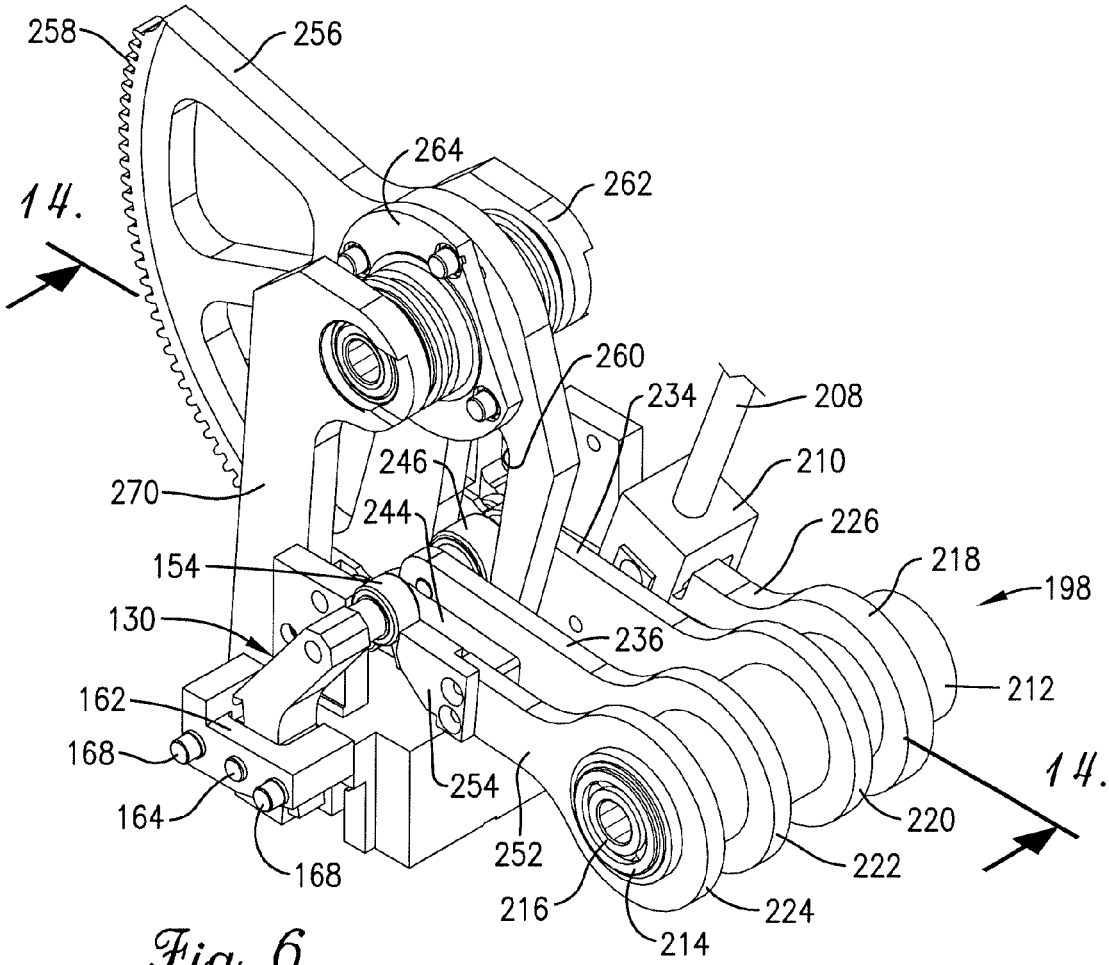
FIG. 6 is a fragmentary isometric view illustrating portions of the torque tube assembly, and the gear hub and cover assembly.
Figure 7:
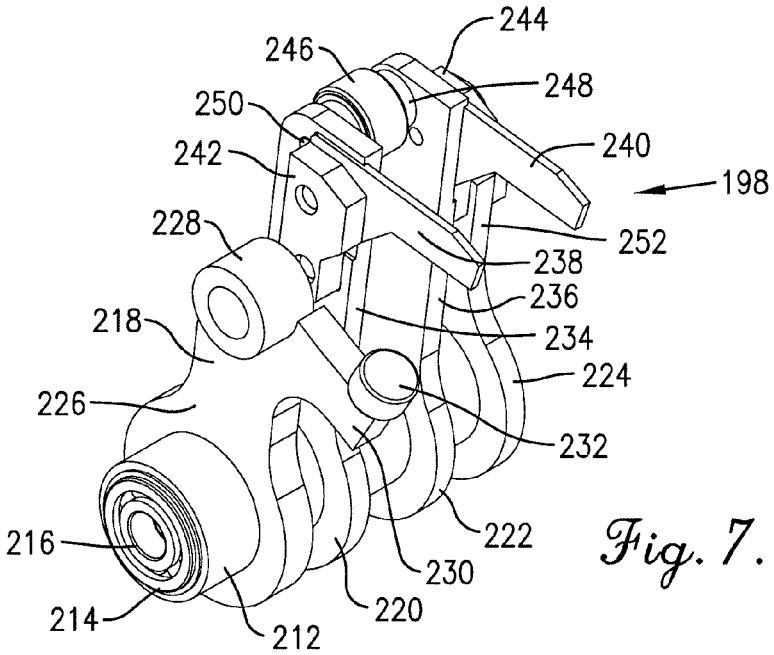
FIG. 7 is a fragmentary isometric view of portions of the torque tube assembly.

The torque tube assembly 58 is best illustrated in FIGS. 5-7, and generally includes a drive assembly 196 as well as an operator assembly 198. The drive 196 includes a piston and cylinder device 200 comprising an elongated hydraulic cylinder 202 having a central mounting block 204 equipped with laterally extending trunnions 206. The cylinder 202 extends through opening 76 of crossplate 74 with the trunnions 206 supported by the bearing blocks 78, 80. In this fashion, the cylinder 202 may rock or pivot relative to the blocks 78, 80 and crossplate 74. The assembly 200 also includes an reciprocal piston rod 208 equipped with a lower most clevis 210. The cylinder 200 is operatively equipped with a source of pressurized hydraulic fluid (not shown).

The operator assembly 200 includes a cross shaft 212 supported on endmost bearings 214. A mounting shaft 216 supports the bearings 214 and extends through cross shaft 212; the shaft 216 is in turn secured to frame plates 68, 70. A total of four operating arms are fixedly secured to cross shaft 212 in spaced relationship along the length thereof, namely a crank and gripper operator 218, a pair of mating hub gear and ejector operators 220, 222 and a cutter operator 224.

The crank and gripper operator 218 includes an elongated projecting body 226 equipped with a clevis mount 228 adjacent the outboard end thereof along with a leg 230 which supports a gripper operator element 232.

The operators 220, 222 similarly include outwardly extending bodies 234, 236. The outboard end of the bodies 234, 236 have wire ejector fingers 238 and 240 secured thereto, along with rocker blocks 242, 244. Additionally, a roller 246 is disposed between the bodies 234, 236 and is supported for rotation via terminal bearing supports 248 and support pin 250.

The cutter operator 224 has an extended body 252 carrying an operator block 254 adjacent the outer end thereof.

As best seen in FIGS. 5 and 6, clevis 210 is pivotally coupled with mount 228 carried by operator body 226. Thus, upon extension or retraction of piston rod 208, the entire assembly 198 is correspondingly pivoted about a rotational axis defined by mounting shaft 216. The various operating components carried by the operators 218-224 are designed to operate, on a sequential basis, the operations of gripping, knotting, cutting and ejecting a final knotted bale wire for application to a compressed bale. This operation will be described in detail below.

Figure 8:
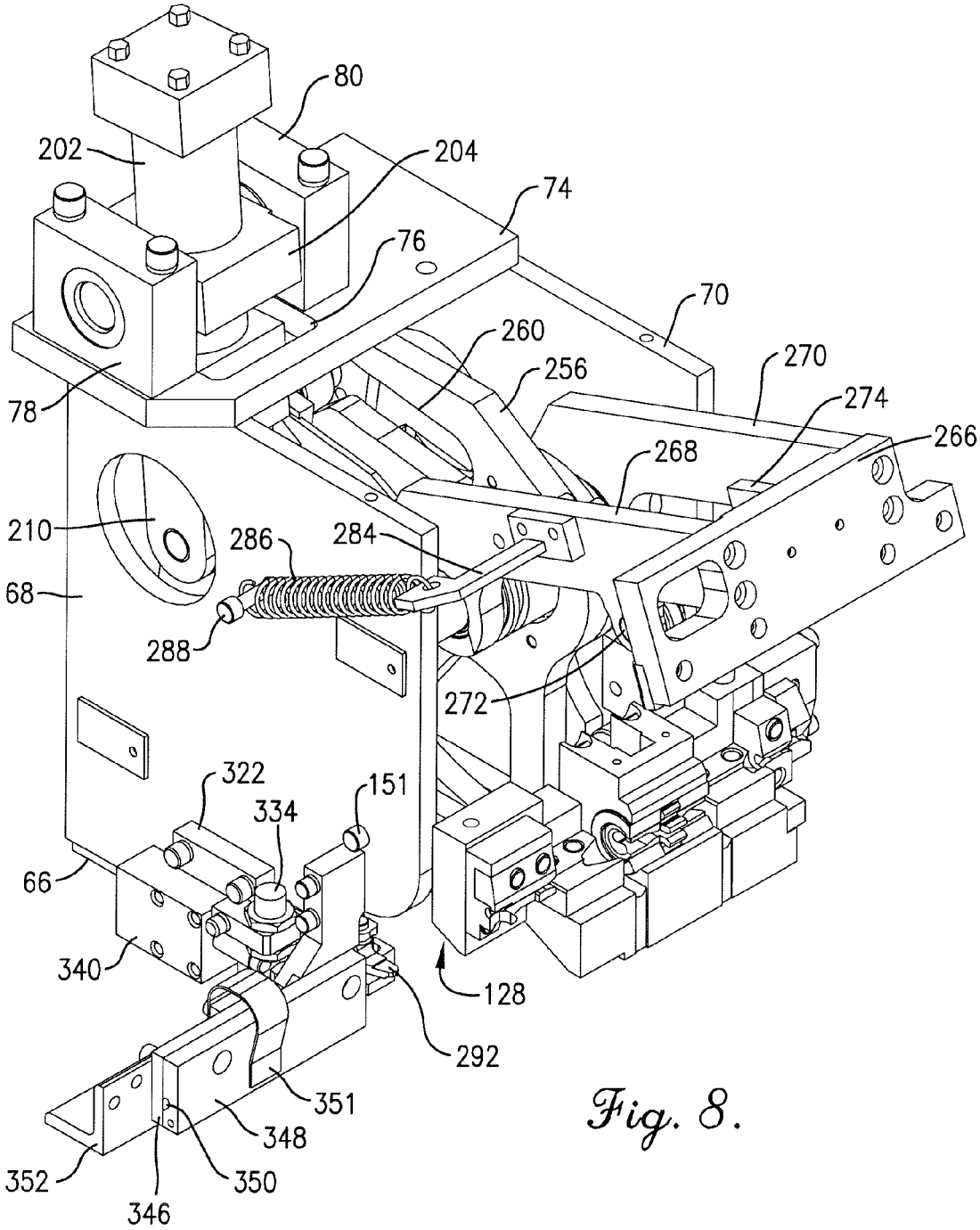
FIG. 8. is an isometric view similar to that of FIG. 2 with the pinch roll and entry assemblies deleted, and showing the knotter cover in its elevated access position and with the knotter assembly open for access.
Figure 9:
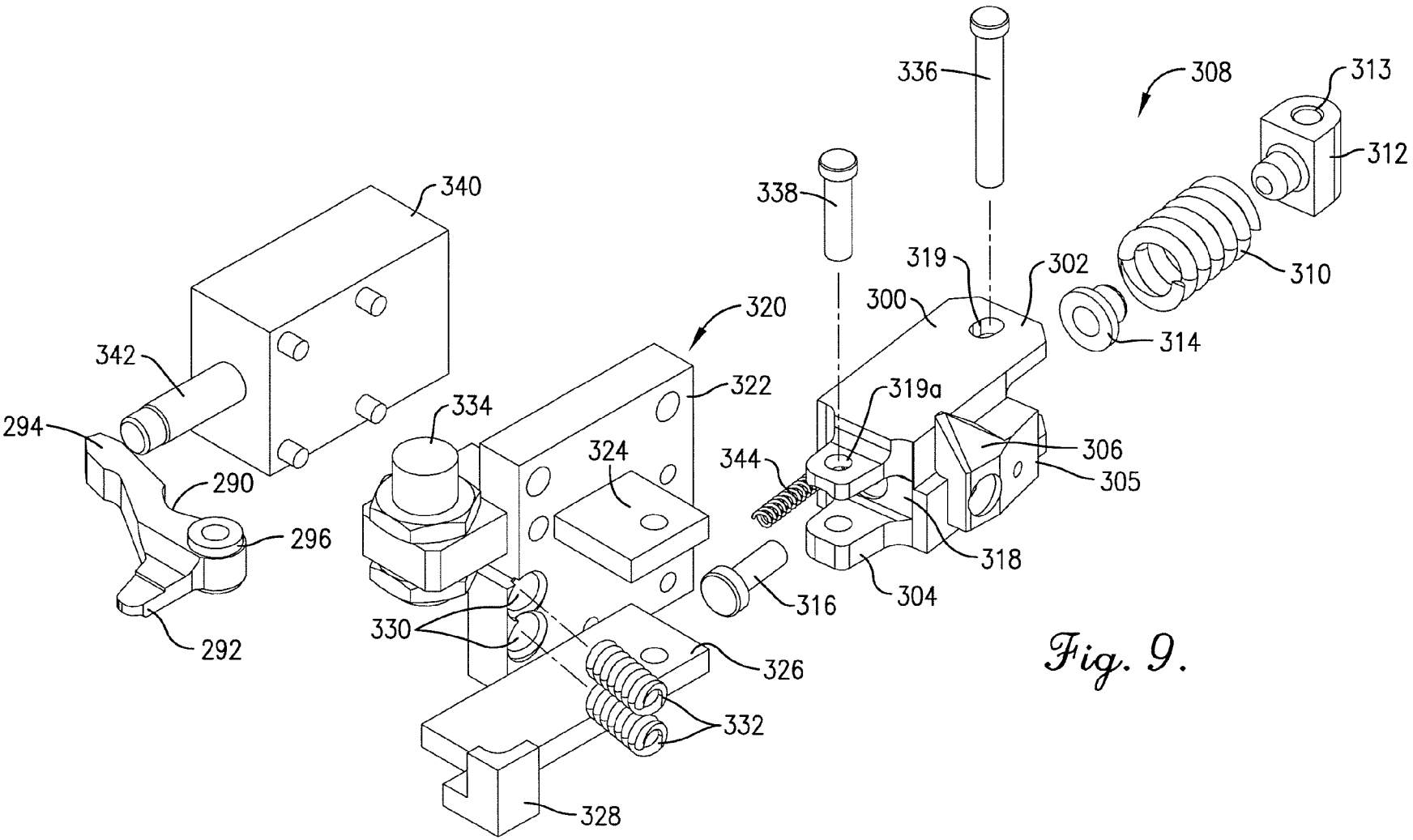
FIG. 9 is an exploded isometric view illustrating the components of the gripper assembly.

The hub gear and cover assembly 60 is best seen in FIGS. 5 and 8. This assembly includes a central sector gear 256 having a toothed face 258 in mesh with pinion gear 178, and an elongated drive slot 260. The gear 256 is secured to a transverse support shaft assembly 262 by means of coupler 264 (see FIG. 6). The ends of the shaft assembly 262 are rotatably secured at the outer ends thereof to the frame walls 68, 70 thereby allowing the shaft assembly 262 to pivot with sector gear 256.

The overall hub gear and cover assembly 60 further includes a knotter cover 266 which is normally disposed beneath the knotter assembly 56. The cover 266 is in the form of an apertured plate as best seen in FIG. 8. The cover 266 is supported by a pair of upright arms 268, 270 disposed on opposite sides of gear 256. Each arm 268, 270 is mounted via appropriate bearings onto the shaft assembly 262, with the latter being rotatable relative to the arms. Each of the arms includes an inwardly extending rotatable abutment 272, 274. As best seen in FIGS. 17-20, the cover supports a rockable, spring-biased, bifurcated retainer 276 which extends inwardly and presents upstanding nibs 278. A pair of springs 280, mounted on pins 282, bias retainer 276 to its upraised position best illustrated in FIG. 20. Finally, as illustrated in FIG. 2, the arm 268 has a laterally extending spring connector 284. A coil spring 286 is extends between connector 284 and stud 288 affixed to frame wall 68. The spring 286 biases the cover 266 inwardly towards gear 256.

The gripper 62 is illustrated in FIGS. 9 and 21-23. Generally, the gripper has a dogleg-shaped, wire-engaging gripper component 290 with a wire-engaging end 292 and an actuator end 294. The component 290 has a central bearing section 296 and a spring recess 298. The gripper 62 also includes a spring loaded, pivotal block 300 presenting opposed pairs of endmost connection ears 302 and 304 and a threadably attached central operator segment 305 including an inclined operating surface 306 which is important for purposes to be described.

A spring assembly 308 is housed within block 300 and comprises a central coil spring 310 positioned between a retainer cap 312 having a bore 313 and a lower annular retainer 314. A headed pin 316 extends upwardly through the base 318 of block 300 and retainer 314 into the confines of spring 310. It will be noted that the ears 302 are provided with elongated slots 319, and that the ears 304 have circular openings 319*a*.

Figure 21:
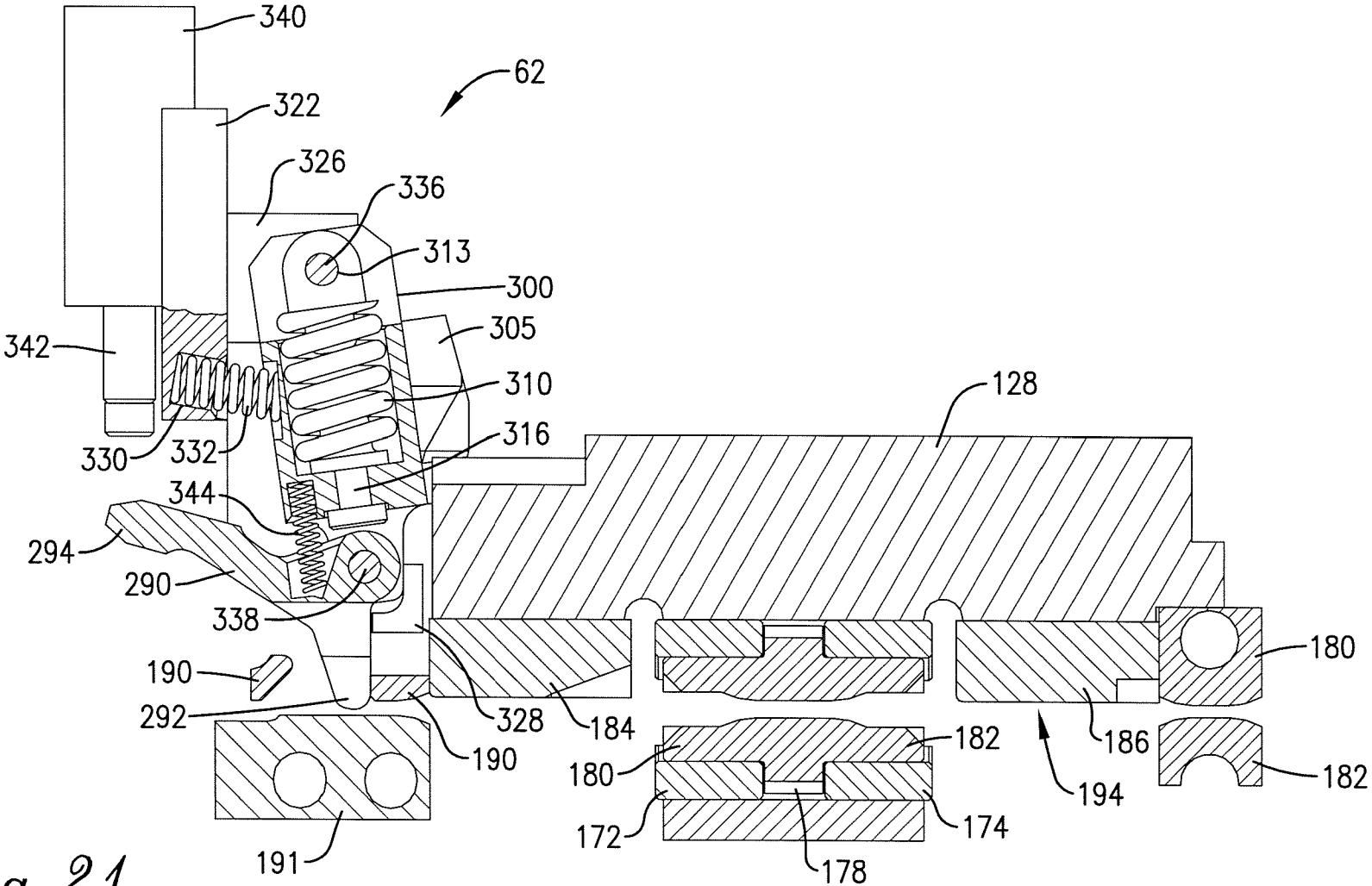
FIG. 21 is a sectional view taken along line 21-21 of FIG. 4, and illustrating the knotter and gripper assemblies, prior to initiation of a baling operation.
Figure 22A:
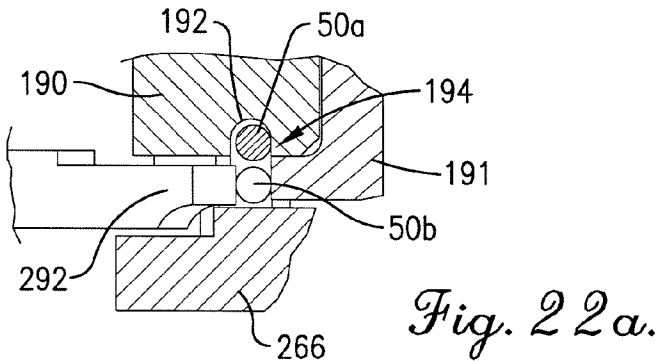
FIG. 22*a* is a cross-sectional view taken along line 22*a*-22*a* of FIG. 22, particularly showing the gripped end section of the wire below the other section of wire.
Figure 22:
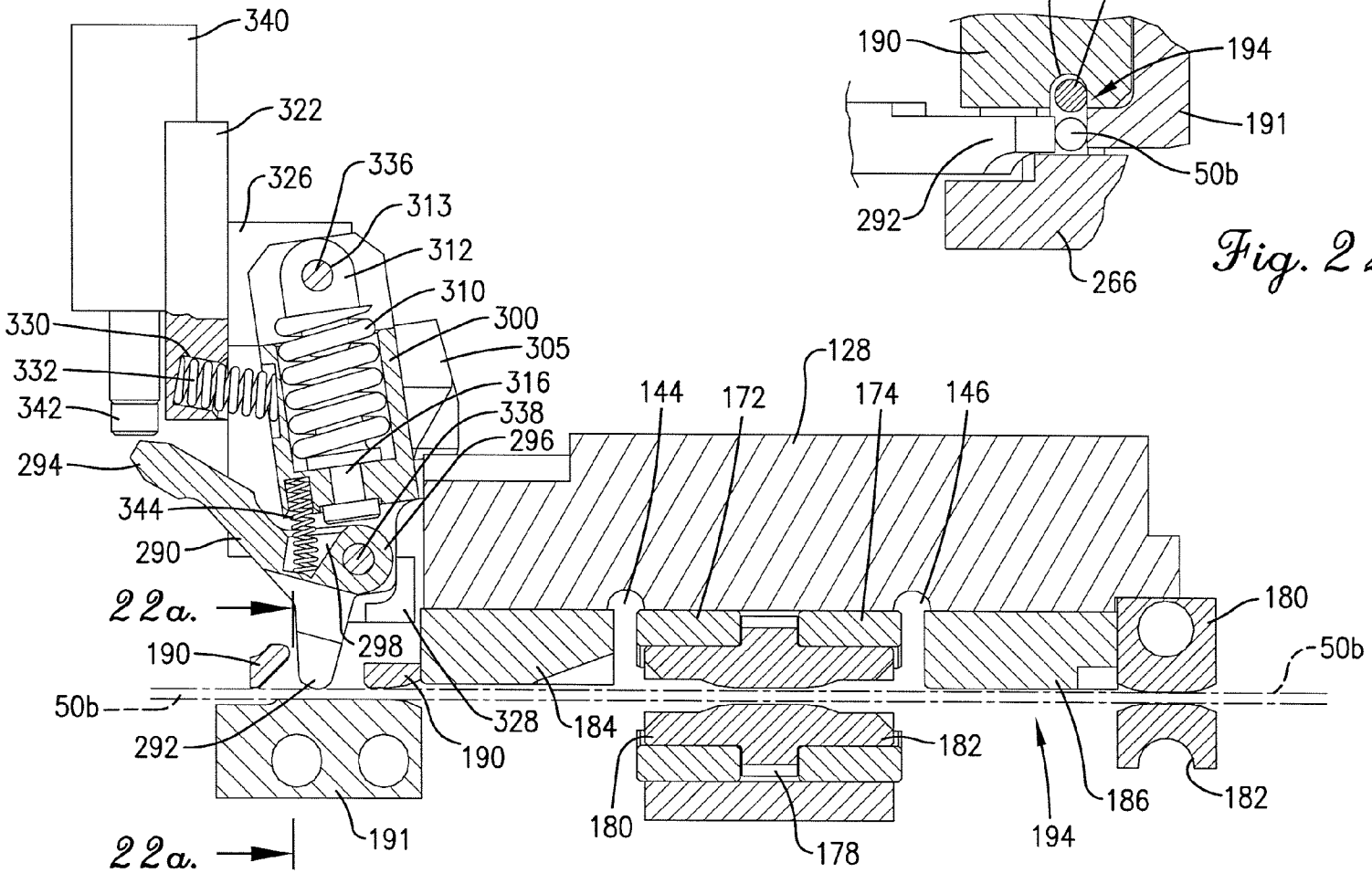
FIG. 22 is a sectional view similar to that of FIG. 21, but showing a wire within the knotter and gripper assemblies, with the latter holding the wire in place.
Figure 23:
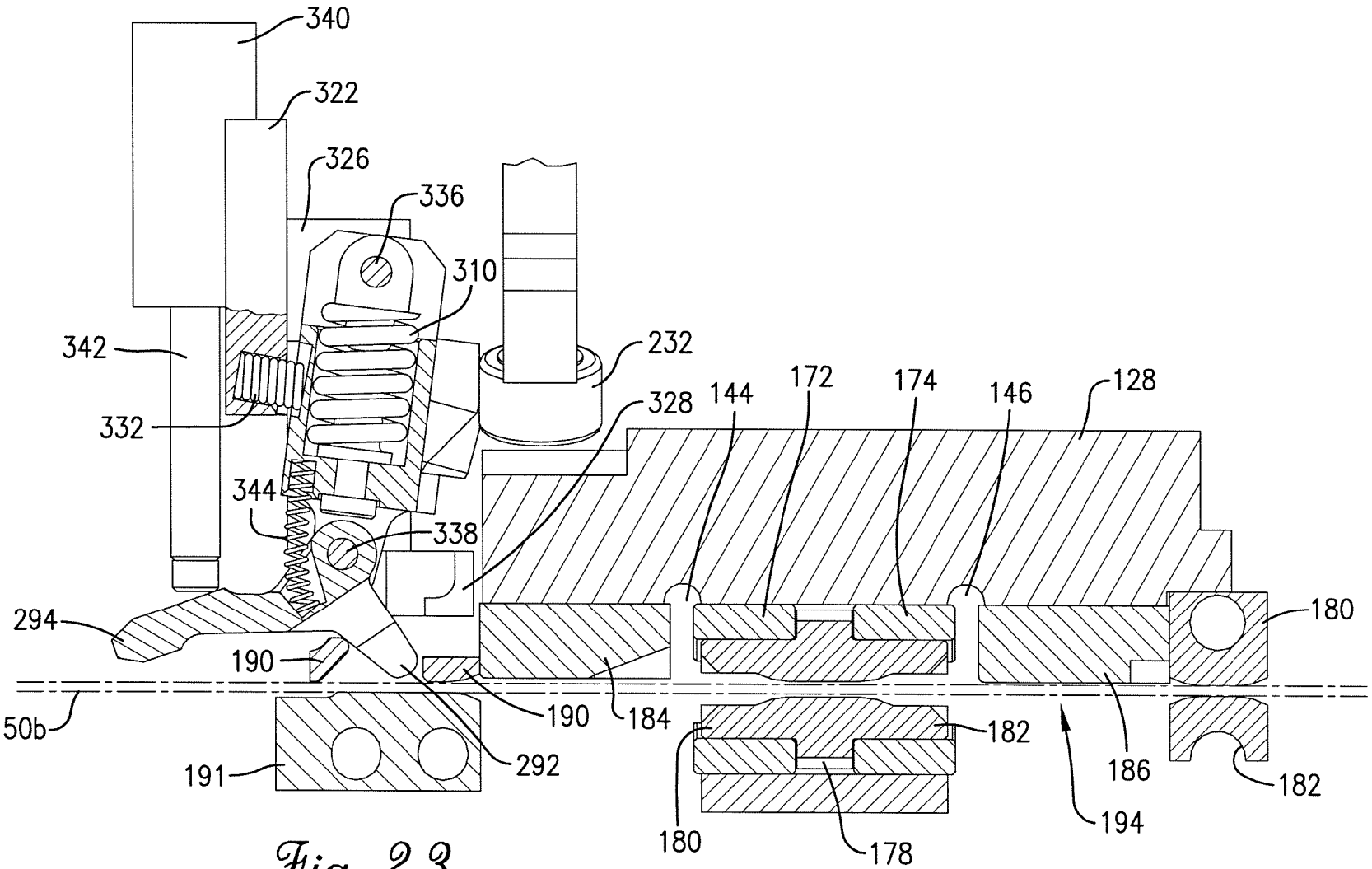
FIG. 23 is a view similar to that FIG. 22, but showing the gripper in its release position.

The block 300 is supported on a connector 320 including an upright plate 322 having an upper apertured tab 324 as well as an opposed apertured tab 326, the latter having a stop block 328 secured thereto. Additionally, the plate 322 has a pair of blind spring recesses 330 adapted to receive coil springs 332. The plate 322 is directly secured to frame sideplate 68 and also supports a proximity sensor 334. A first connection pin 336 extends through the opening of tab 324, slots 319 and cap bore 313, and finally through the bore of opposed tab 326, to thereby pivotally mount one end of the block 300. Another connection pin 338 extends through the openings 319*a* of ears 304 and bearing section 296 of component 290 to complete the connection. A coil biasing spring 344 extends between the block 300 and is received within spring recess 298 of component 290. Additionally, the coil springs 332 are seated within the recesses 330 and engage block 300 as best seen in FIGS. 21-23. Finally, a cylinder 340 is affixed to plate 322 and has a selectively extendable rod 342 configured to engage the actuator of component 290.

Exit assembly 64 includes a pair of abutting plates 346 and 348, with the plate 346 having an upstanding projection secured to the outer face of frame plate 68. The plates 346, 348 cooperatively define a wire passageway 350 which is in alignment with passageway 194 of knotter assembly 56. A spring retainer clip 351 is in bridging relationship to the plates 346, 348, in order to yieldably hold the plates together while permitting separation thereof so as to permit release of a tensioned and knotted wire bale. An L-shaped connector 352 serves to connect the exit assembly 64 with continuous track 44.

Operation

The operation of baler 30 will now be described in the context of applying a tensioned and knotted wire tie about a compressed refuse bale. In this discussion, it will be assumed that the strapping device is in a ready condition, i.e., that a wire has previously been applied to the same or an earlier bale, and that the leading end of the wire 50 is positioned just upstream of the wire shearing surface 158 of cutter element 130. Moreover, the gripper 62 is in the FIG. 21 released position thereof, and the torque tube assembly is in the FIG. 2-3 position thereof.

When a bale is properly positioned relative to the outlet opening 38 of ejection ram chamber 34 in location to receive a knotted and tensioned wire tie, a sensor (not shown) associated with the chamber 34 sends an initiation signal to device 46. Next, the pinch roll assembly 52 is actuated via drive motor 94 and the coupled gear train in order to rotate the wire grippers 100, 102 and 108, 110 so as to advance the wire 50, and thus draw wire from the wire stand 48. Specifically, the assembly 52 advances the wire 50 along the passageway 194 through the remainder of the knotter assembly 56, exit assembly 64, and then completely around the guide track 44 until the leading end of the wire encounters wire path 122 defined by entry assembly 54. At this point the leading end of the wire passes beneath the wire section already situated within the knotter assembly 56 and the region of gripper 62. This condition is illustrated in FIG. 22*a*, where it will be seen that the section of wire 50*a* extends completely around the track 54, and the shorter section 50*b* lies beneath the portion of wire 50*a* within the knotter assembly 56.

The advancement of the wire 50 continues until the leading edge thereof passes and engages the wire engaging edge 292 of gripper component 290. This causes the component 290 to slightly pivot in a clockwise direction as viewed in FIG. 21 until the component assumes the initial gripping position depicted in FIG. 22. In this orientation, the gripping end 292 engages the wire section 50*a* and the actuator 294 is moved to a position beneath sensor 334.

The sensor 334 is capable of detecting the presence of the metallic actuator. This causes a signal to be sent to the assembly 52 to stop the advancement of wire, and to reverse the operation thereof. This begins tensioning the wire section 50*a* extending around track 44 to thereby draw the sections 50*a* and 50*b* taut. During the course of this reverse movement, the component 292 is moved rightwardly (FIG. 22) because of the engagement with the wire until block 328 is encountered. Further reverse wire movement draws the end 292 of component 290 into tight gripping engagement with the wire, pressing the latter against block 191. To insure the wire is gripped, cylinder 340 is actuated. The rod 342 thus engages actuator 294 in order to pivot the component 290 counterclockwise about axis pin 338, extending spring 334. The final wire-gripping position is illustrated in FIG. 22. This reverse movement of the assembly 52 continues until an appropriate tension is created in the wire, which is sensed by a sensor (not shown) associated with assembly 52. At this point the operation of the assembly 52 entirely terminates, and a signal is sent to drive assembly 196.

The drive assembly 196 is then actuated in order to sequentially twist-knot the wire sections 50*a*, 50*b*, to cut the wire section 50*a*, to shift the cover 266 from its wire-maintaining home position, and to eject (if necessary) the knotted and tensioned wire tie from the knotter assembly 56 and through the separable sections of track 44, in order to cause the completed wire tie to envelop the refuse bale. These actions are all accomplished through the medium of the single operator assembly 198.

Figure 17:
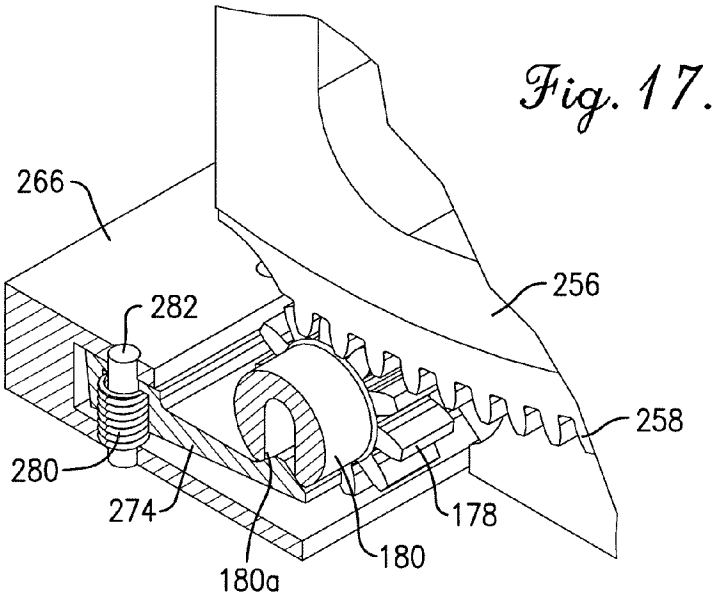
FIG. 17 is a fragmentary, sectional isometric view illustrating the interengagement between the knotting pinion and the sector gear forming a part of the gear hub and knotter cover assembly, prior to commencement of the wire knotting operation.
Figure 18:
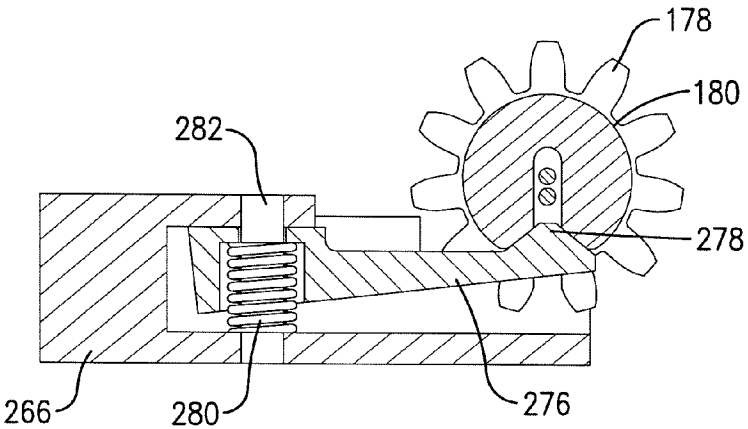
FIG. 18 is a fragmentary, sectional view illustrating a wire within the knotting pinion with the knotting cover in its operative position.
Figure 19:
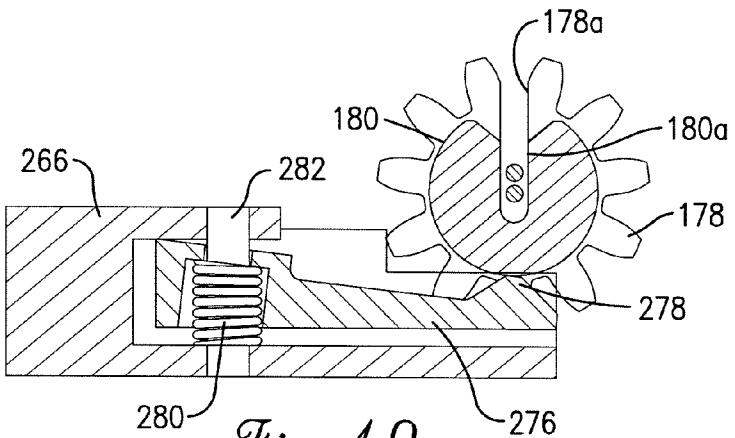
FIG. 19. is a view similar to that of FIG. 18, but illustrating the knotting pinion during a wire knotting operation.
Figure 20:
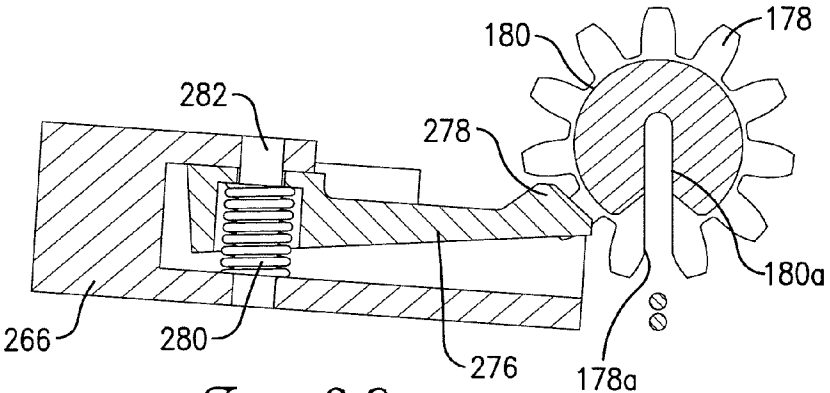
FIG. 20 is a view similar to that FIG. 19, but showing the cover displaced from the knotting pinion in order to permit withdrawal of the knotted wire from the pinion.

In more detail, the piston and cylinder device 200 is actuated in order to extend rod 208. This rotates cross shaft 212 about mounting shaft 216, i.e., the clevis 210 operates to rotate crank and gripper operator 218 which thus rotates the entire assembly 198. At this point the sector gear 256 is pivoted by virtue of the roller 246 attached to the operators 220, 222 and riding within drive slot 260. Inasmuch as the toothed face 258 of gear 256 is in meshed, driving engagement with pinion gear 178, the latter is rotated. During such rotation the wire sections 50*a*, 50*b* within the pinion slot 178*a* and adjacent slots 180*a* and 182*a* are twisted together a desired number of turns (in the present embodiment four) along the length of passageway 194, as schematically illustrated in FIGS. 17-19. During such twisting operation, the retainer 276 and specifically nib 278 thereof serve to maintain the wire sections within the stationary sections 180, 182, while the cover 266 ensures that the remainder of the wires remain within passageway 194.

Figure 11:
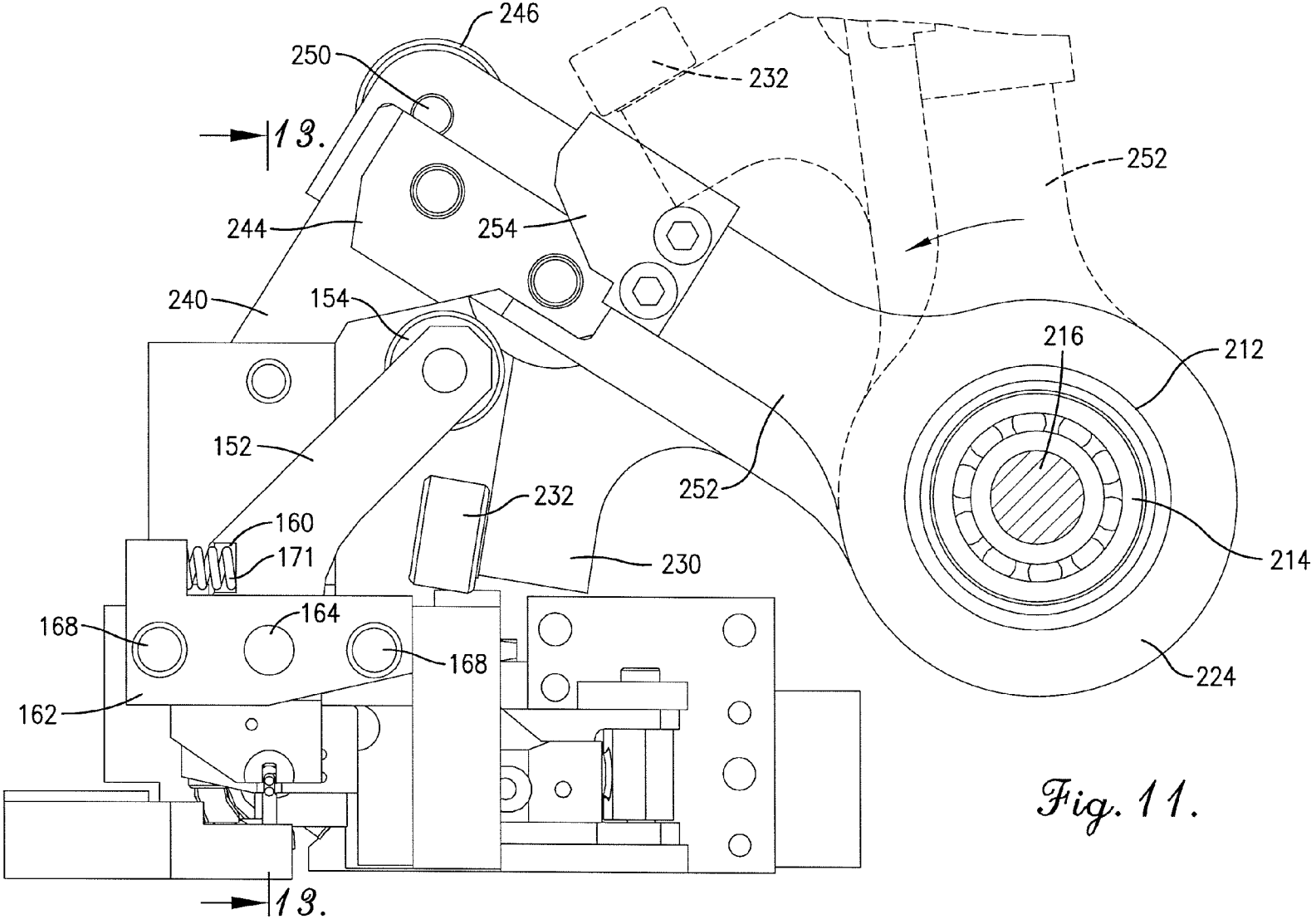
FIG. 11 is a vertical sectional view taken along line 11-11 of FIG. 4 and illustrating the wire cutter forming a part of the knotter assembly prior to operation of the wire cutter.
Figure 12:
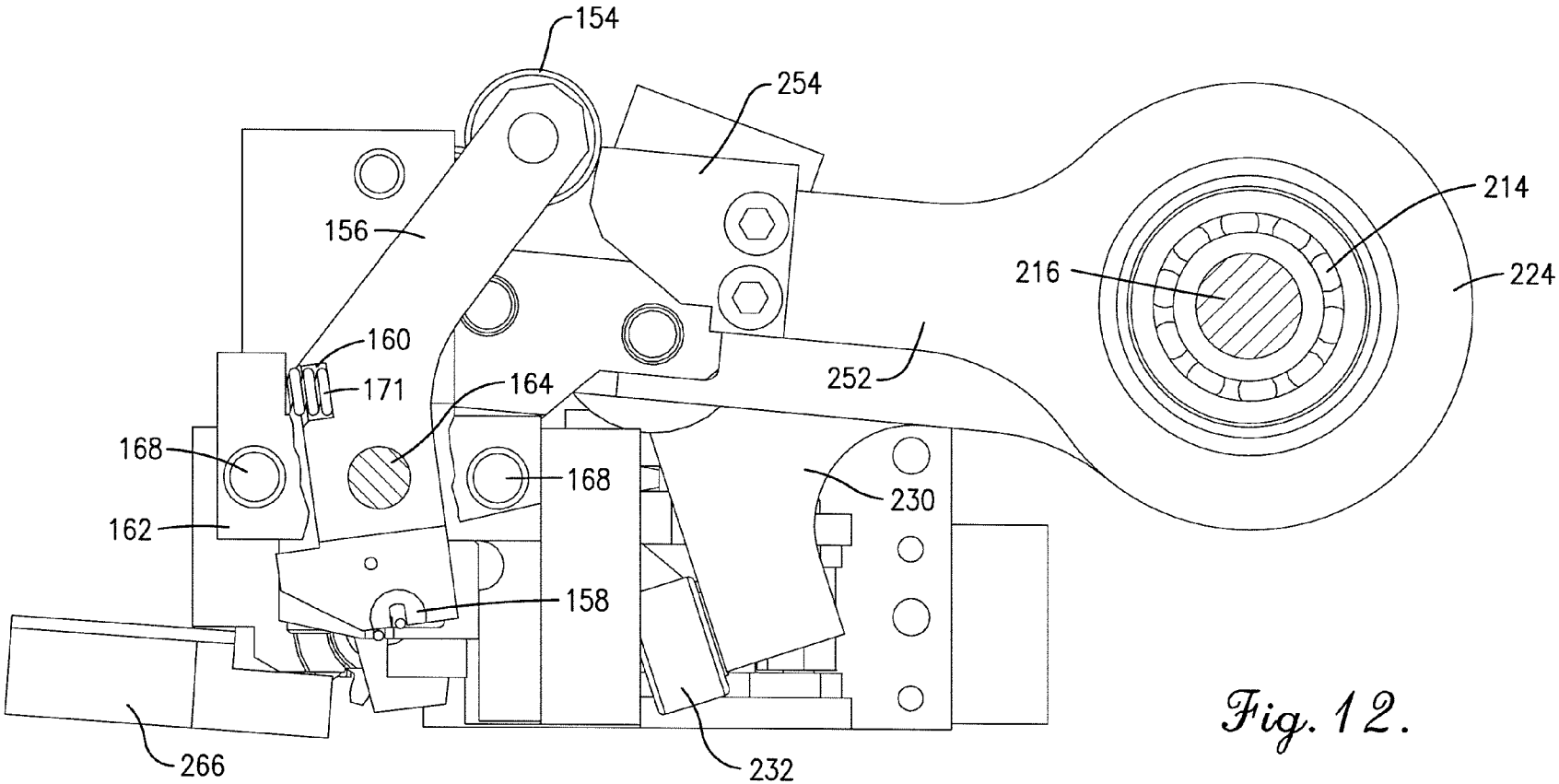
FIG. 12 is a vertical sectional view similar to that of FIG. 11, but depicting the cutter after the wire has been cut.

Next, the cutter operator 224 comes into play by engagement of block 254 with the follower 154 secured to the upper end of section 152 of knife element 130. Referring to FIGS. 11 and 12, it will be seen that such engagement causes the knife element to rock about pin 164 so as to shear cut the wire section 50*a*.

In the next step, the gripper 62 is released to free the knotted and tensioned wire tie. Specifically, the gripper operator element 232 carried by operator 218 is pivoted into engagement with oblique surface 306 of body 305 carried by block 300. Such engagement causes the body 300 to be pivoted over center about the axis defined by connecting pin 336 and against the bias of springs 332. Such over center pivoting is accommodated by the slots 319 formed in ears 302 (see FIG. 9). It will further be appreciated that during this over center travel of block 300, the pin 316 engages the section 296 of component 290 so as to move the latter toward block 191, past stop block 328. Because of the arcuate configuration of end 292, a rolling action occurs during gripper release, i.e., the end 292 "rolls" along the wire which avoids undue stress concentrations.

Shortly after the gripper 62 is released, the cover 266 is moved upwardly so as to permit ejection of the knotted and tensioned wire tie. This occurs because of the interaction of the rocker blocks 242, 244 carried by the operators 220, 222, with the abutments 272, 274 carried by arms 268, 270. Such interaction causes the cover 266 to be shifted outwardly as depicted in FIGS. 15, 16 and 19, thereby fully opening passageway 194. Normally, the tension of the knotted wire tie is sufficient to cause the latter to rapidly eject of its own accord from the knotter assembly and to separate the sections of track 44. However, as a further measure, the ejector fingers 238, 240 (see FIGS. 15-16) pass through the slots 144, 146 to engage and positively eject (if needed) the knotted and tensioned wire tie from the passageway 194. Thus, the wire tie separates the wire-receiving plates of the entrance and ejection assemblies 54, 64 against the bias of the clips 124, 126, and 351, and also separates the spring-loaded sections of track 44. This allows the twisted wire bale to "snap" into place around the refuse bale.

The device 46 then returns to its ready position for another tying sequence. This involves actuation of device 200 to retract piston rod 208. When this occurs, the gear 256 returns to its original position along with the components of operating assembly 198. The cover 266 resumes its normal position, under the influence of spring 286. The gripper 62 returns to its ready position by springs 332 causing the block 300 to shift back over center so that the gripper 62 again assumes the FIG. 21 release position. The device 46 is thus again ready to create a knotted and tensioned wire tie.

A feature of the present invention is the provision of a knotter assembly cover 266 which can be readily shifted to a remote knotter access position (see FIG. 8) allowing easy replacement or repair (e.g. clearing) of the knotter assembly 56. In particular, when such replacement or repair is needed, it is only necessary to grasp the cover 266 and rotate it upwardly through an arc of at least 90° and more preferably at least 120° to the knotter access position of FIG. 8. It will be observed that during the course of this pivoting the spring 286 goes over center, and thus biases the cover to the remote position. Hence the spring 286 serves a dual purpose in the device 46.

Moreover, because primary block 128 of assembly 56 is mounted to the frame plates 68, 70 by threaded connectors 151, it is a simple matter to remove the fasteners 153 and pivot the body through an arc of approximately 90° until the body assumes the FIG. 8 position. It will be noted that in this position there is ready access to the pinion assembly 132. This procedure can easily be reversed by pivoting the body 128 back downwardly to its original position and inserting and tightening the fasteners 153.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. In a knotting device including a rotating drive element, a rotatable knotter that drivingly engages the drive element in an operating position to twist-knot a pair of adjacent wire sections, and a cover located adjacent said knotter in a wire-maintaining position for maintaining the wire sections within the knotter during feeding and knotting, the improvement which comprises a mount for said knotter permitting the knotter to be pivoted from the operating position to a non-operative position allowing servicing of the knotter, said knotter shifting away from the drive element while pivoting from the operating position to the non-operative position, with the knotter being drivingly disengaged from the drive element in the non-operative position.

2. The device of claim 1, said knotter comprising a rotatable pinion that presents a slot adapted to receive said adjacent wire sections, said drive element comprising a sector gear that drivingly intermeshes with the pinion in the operating position.

3. The device of claim 1, said knotter mount comprising an elongated support body, said body being selectively rotatable to said non-operative position.

4. The device of claim 3, including an upright frame member proximal to said knotter, said support body being releasably secured to said frame member and pivotal relative thereto to move the support body and knotter to said non-operative position.

5. The device of claim 4, including a threadable connector securing said support body to said frame member.

6. The device of claim 1, said rotating drive element being rotatable about an axis, said knotter shifting radially relative to the axis to become disengaged from the drive element while pivoting from the operating position to the non-operative position.

7. The device of claim 1; and a cover mount that permits the cover to be pivoted away from said knotter to a knotter access position remote from said wire-maintaining position and through a pivot arc of at least about 90°.

8. The device of claim 7,
said arc being greater than about 120°.
9. The device of claim 7,
said knotter comprising a rotatable pinion that presents a slot adapted to receive said adjacent wire sections,
said drive element comprising a sector gear that drivingly intermeshes with the pinion in the operating position.
10. The device of claim 7; and
a spring operably coupled with said cover for biasing the cover up to said wire-maintaining position thereof.
11. The device of claim 10,
said spring also operable to bias the cover to said knotter access position upon pivoting of the cover to the knotter access position.
12. The device of claim 11,
said spring secured to said cover and shiftable over center with the cover.
13. The device of claim 7,
said cover mount comprising an arm secured to said cover,
said arm being pivotal about an axis remote from said cover and generally parallel thereto.
14. The device of claim 7,
said knotter rotatably mounted on an elongated support body,
said body being selectively rotatable when said cover is in said knotter access position to the non-operative position permitting ready replacement or repair of the knotter.
15. The device of claim 14; and
an upright frame member proximal to said knotter,
said support body being releasably secured to said frame member and pivotal relative thereto to move the support body and knotter to said non-operative position.
16. The device of claim 7,
said cover being manually shiftable from said wire-maintaining position to said knotter access position.
17. The device of claim 1;
a gripper for selectively gripping one of the pair of adjacent wire sections;
a cutting element for cutting the other of the pair of adjacent wire sections after twist-knotting of the sections,
said shiftable cover located adjacent said knotter for maintaining the wire sections within the knotter during feeding and twist-knotting and thereafter movable to a wire-clearing position permitting passage of the twist-knotted wire sections from the knotter; and
an operator assembly for timed operation of said gripper, knotter, cutting element and cover,
a single drive assembly coupled with said operator assembly for effecting said timed operation.
18. The device of claim 17,
said drive assembly comprising a piston and cylinder assembly including a reciprocal piston rod operably connected with said operator assembly.
19. The device of claim 17,
said operator assembly including a pivotal shaft assembly carrying respective operator bodies for said gripper, knotter, cutting element and cover.
20. The device of claim 19,
said cover attached to a cover mount for pivotal movement of the cover between said wire-maintaining position and said wire-clearing position; and
a spring operably coupled with said cover mount for biasing the cover to said wire-maintaining position thereof,
said cover operator body configured to engage said cover mount to move the cover from said wire-maintaining position to said wire-clearing position.
21. The device of claim 20,
said cover mount permitting selective pivoting of the cover from said wire-maintaining position to a remote knotter access position and through an arc of at least about 90°.
22. The device of claim 21,
said spring acting to maintain said cover in said knotter access position.
23. The device of claim 21,
said knotter rotatably mounted on an elongated support body,
said body being selectively rotatable when said cover is in said knotter access position to a non-operative position permitting ready replacement or repair of the knotter.
24. The device of claim 23; and
an upright frame member proximal to said knotter,
said support body being releasably secured to said frame member and pivotal relative thereto to move the support body and knotter to said non-operative position.
25. The device of claim 17,
said operator assembly drivingly engaging the drive element to operate the knotter.

* * * * *